US006916106B2

(12) United States Patent
Xingguo

(10) Patent No.: US 6,916,106 B2
(45) Date of Patent: Jul. 12, 2005

(54) BICYCLE REPAIR TOOL ASSEMBLY

(75) Inventor: Zhou Xingguo, WuHan (CN)

(73) Assignee: Acumen, Inc., Sterling, VA (US)

( * ) Notice: Subject to any disclaimer, the term of this patent is extended or adjusted under 35 U.S.C. 154(b) by 63 days.

(21) Appl. No.: 10/682,556

(22) Filed: Oct. 10, 2003

(65) Prior Publication Data

US 2005/0078480 A1 Apr. 14, 2005

(51) Int. Cl.[7] ..... F21V 33/00

(52) U.S. Cl. ..... 362/253; 362/120; 362/226; 7/138; 7/165

(58) Field of Search ..... 7/100, 138, 165; 362/253, 800, 119, 120, 227, 226, 458, 457

(56) References Cited

U.S. PATENT DOCUMENTS 4,480,295 A * 10/1984 Shuster ..... 362/206
6,112,351 A * 9/2000 Hawkins et al. ..... 7/138
6,276,014 B1 * 8/2001 Lee ..... 7/158
6,705,183 B1 * 3/2004 Dickens ..... 81/437

* cited by examiner

*Primary Examiner*—Sandra O'Shea

*Assistant Examiner*—Sharon Payne
(74) *Attorney, Agent, or Firm*—Crowell & Moring LLP

(57) ABSTRACT

A cylindrical repair tool has each end configured as a handle, with each handle being separable from one another. One handles is provided with a shaft with a wrench, that, when fully extended, can pivot 90°. At least two diametrically opposed LEDs are arranged on each side of the aperture. On the side of this one handle, hex wrenches and a screw driver can be magnetically held or stored parallel to the shaft central axis. The other handle of the tubular repair tool is a two-part casing that can pivot open to allow access to a variety of tools pivotally mounted inside the casing.

20 Claims, 4 Drawing Sheets

BICYCLE REPAIR TOOL ASSEMBLY

BACKGROUND AND SUMMARY OF THE INVENTION

The present invention relates to a repair tool assembly and, more particularly, to a compact, lightweight tool designed in the shape of a tube or cylinder for easy storage and used for bicycle repair and the like.

Generally speaking, the cylindrical repair tool according to the present invention has each end configured as a handle, with each handle being separable from one another. One of the handles is provided with an extendable shaft with a wrench, typically an 8 mm wrench that, when fully extended, can pivot 90°, which can move from a retracted position within the handle to an extended position or positions from the end surface thereof. In addition, at least two diametrically opposed LEDs are arranged on each side of the aperture through which the shaft can extend to illuminate and thereby facilitate repairs at night or under poor lighting conditions. On the side of this one handle, hex wrenches and a screw driver can be magnetically held or stored parallel to the shaft central axis. This handle can also include the power supply circuitry for the LEDs.

The other handle of the tubular repair tool is made into a two-part casing of plastic or the like with a cover that can pivot open to allow access to a variety of tools pivotally mounted inside the casing. The tools can include, for example, a two-piece tire tool, 9 and 14 mm wrenches, a chain tool and a combined bottle opener and wrench. The surfaces of each handle can be configured to enhance gripping of the tool when operating with one or the other handle. The chain tool is designed to serve as a more convenient way to repair the links of a chain. The two-part casing also serves as a locking mechanism whereby the selected tool or tools can apply torque in a clockwise or counterclockwise direction.

BRIEF DESCRIPTION OF THE DRAWINGS

The features and advantages of the present invention will become more readily apparent from the following detailed description of a currently preferred configuration thereof when taken in conjunction with the accompanying drawings wherein.

DETAILED DESCRIPTION OF THE DRAWINGS

Figure 1:
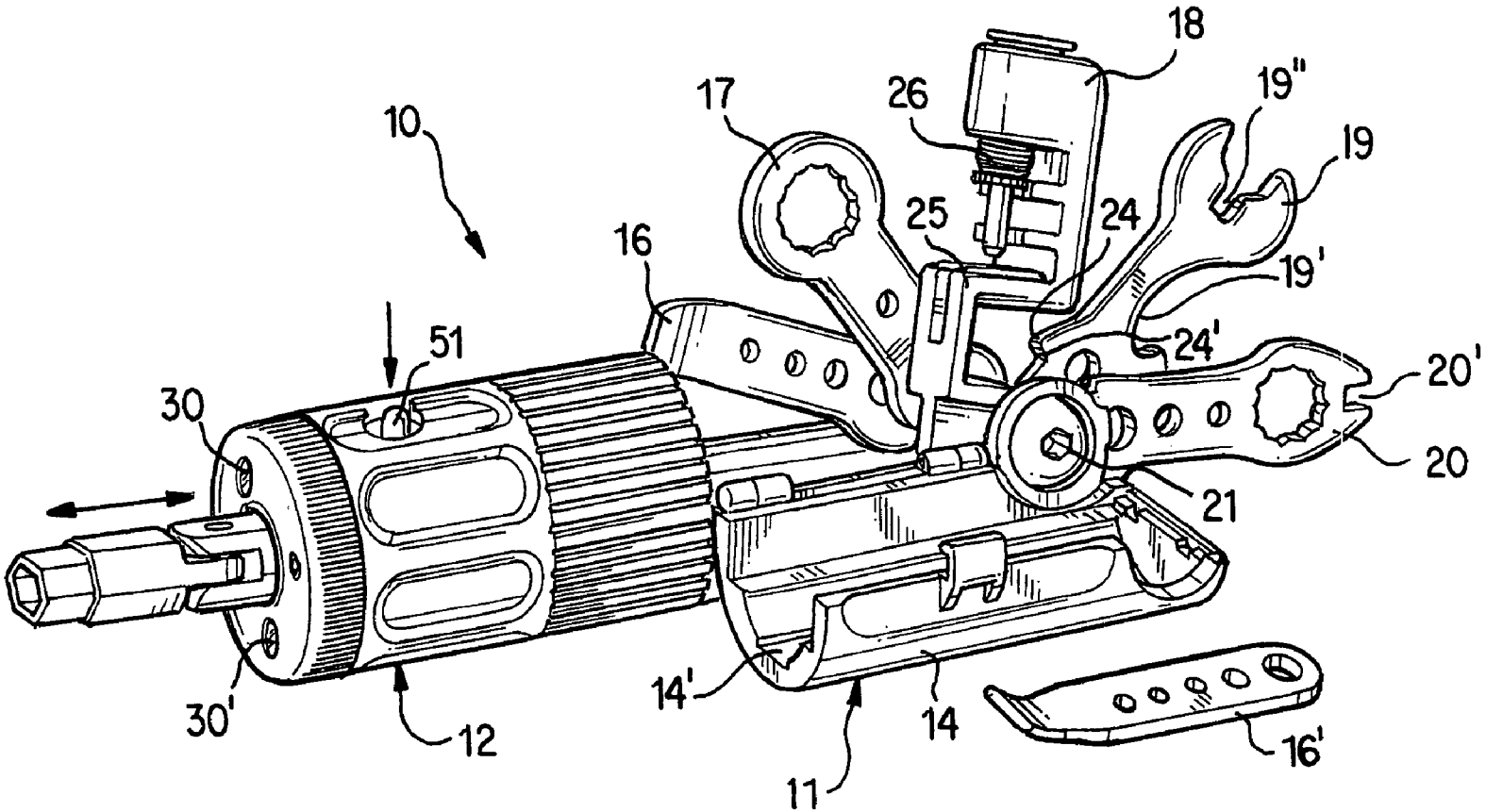
FIG. 1 is a perspective view of the repair tool assembly according to the present invention with the cover of one handle pivoted to the open position and the multiple tools therein shown in various positions of extension outside the tool body.

Referring now to the drawings and, in particular, to FIG. 1, the repair tool assembly according to the present invention is designated generally by the numeral 10. The tool assembly 10 is comprised of two handles, the first handle being designated generally by numeral 11 and the second handle generally by numeral 12. The first handle 11 consists of a lower part 13 and an upper part 14 joined by hinges 15, 15' on one side (see, e.g., FIG. 3) so that the upper part 14 can be swung open to the position shown in FIG. 1 and provide access to one or more of the tools 16, 17, 18, 19 and/or 20 pivotally mounted around a pivot pin 21 or the like extending across the lower part 13. It is to be understood that the position of the tools 16, 17, etc., shows in FIG. 1 is for purposes of illustrating their relative arrangement and is not an illustration of the tools in an operative position.

Figure 5:
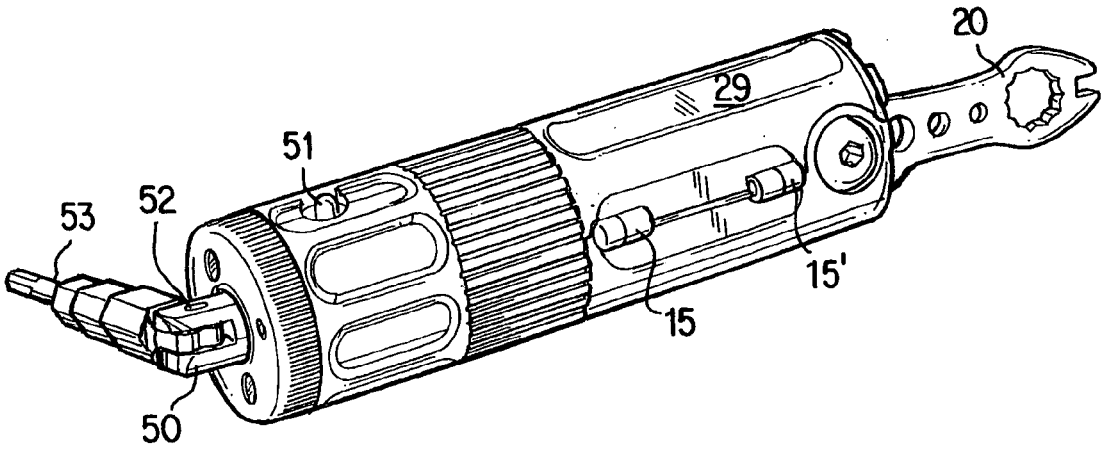
FIG. 5 is a perspective view similar to FIG. 4 but with the bendable shaft fully extended and bent, via a joint, at a right angle to the axis of the tool body and another tool, e.g., a spoke wrench, extending from the other end of the first body part.

Although a variety of different tools can be provided without departing from the scope of the present invention, in the currently preferred embodiment, the first handle 11 contains a tire lever 16, with a separate lever 16' accommodated with a snug friction fit in a recess 14' of the upper part 14, a box wrench 17 (e.g., a standard 10 mm wrench), a chain tool 18, a box wrench 19 incorporating a bottle opener 19' and a spoke wrench 19", and a box wrench 20 incorporating a spoke wrench 20' at its free end. Generally speaking, only one of these tools will normally be utilized at one particular time in the position shown in, for example, FIG. 5 where the box wrench 20 is shown in the fully extended position on which it is directed along the tool body longitudinal axis. That is, as shown in FIG. 5, the other tools 16, 17, 18 and 19 are usually in their fully retracted position in which they are extended in a direction opposite to the wrench 20 (i.e., extending toward the handle 12) so that the upper part 14 or cover can be pivoted around hinges 15, 15' to the closed position. Of course, two or more wrenches can also be extended to a working position. In the closed position of the upper part or cover 14, the tire lever 16' is held frictionally within the recess 14' so that it is not easily lost or misplaced unless, of course, it has been removed to work on a tire.

Figure 2:
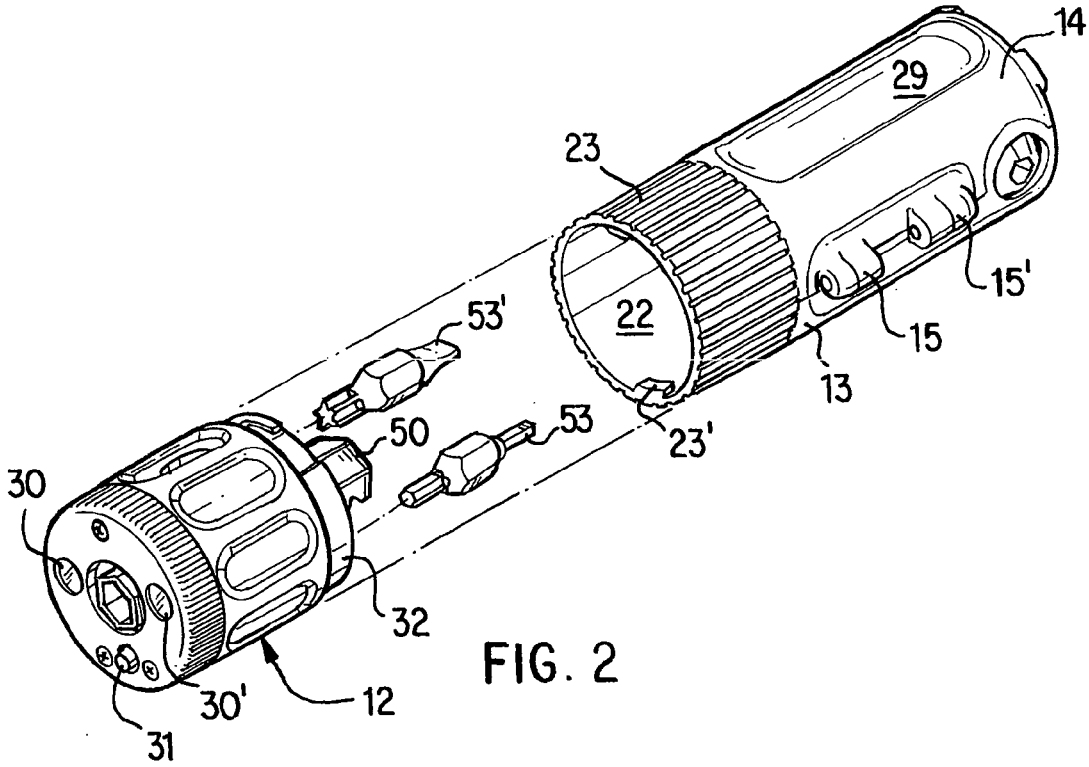
FIG. 2 is a perspective view of the repair tool shown in FIG. 1, but with the two handles of the tool body separated to show two of the hex wrenches in the other handle in an exploded position.
Figure 7:
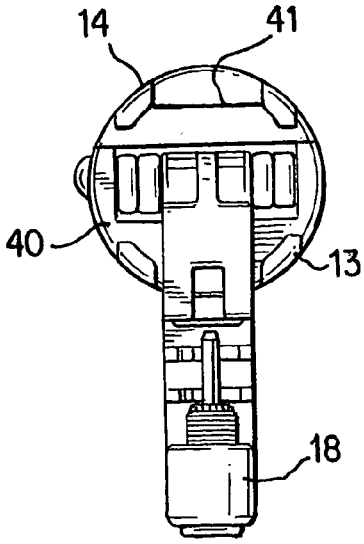
FIG. 7 is a top view of the fully extended chain tool shown in FIG. 6.

In the closed position shown in FIG. 5, the lower and upper parts 13, 14 have end faces 40, 41 (FIG. 7), respectively, which are flush against the sides of the wrench so that the tool 10 can be turned in either direction for applying torque with the wrench 20 or any of the other selected tools on the handle 11. Easy access for manipulating a desired wrench or tool into the fully extended position shown in FIG. 5 can also be obtained by access through the opening 22 formed by the cylindrical portion 23 extending from the end of the lower part 13 facing the second handle 12 as seen in FIG. 2. Each of the wrenches 16, 17, 19 and 20 are provided with raised portions 24 having a dorsal fin-like shape on each of their upper and lower sides so that a flat face of that raised portion 24 abuts against the end faces 40, 41 of the respective lower and upper parts 13, 14 whereby the wrench can be turned to apply a torque in clockwise and counterclockwise directions as previously mentioned.

Figure 6:
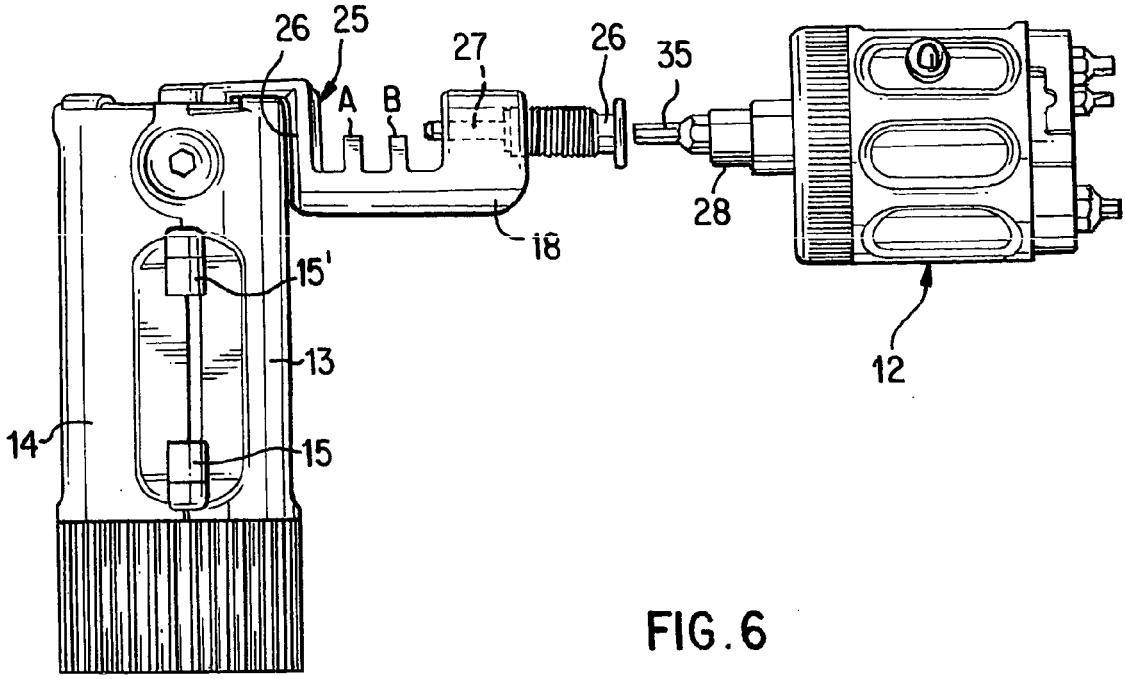
FIG. 6 is a side view showing the chain tool in the one handle in its fully extended and operative position and the hex wrench partially extended from the other handle (similar to that shown in FIG. 4) for advancing and retracting the chain tool pin and screw for repairing a bicycle chain.

The chain tool 18 is designed to be extended to a position at a right angle to the tool body longitudinal axis as shown in FIG. 6. The chain tool 18 has an L-shaped portion designated generally by numeral 25 and is sized so that one face 26 of that L-shaped portion abuts against the end face of the lower part and a flattened portion (similar to the area 29 on the cover 14) also on the lower part 13. The chain tool 18 includes a screw 26 and a pin 27 which can be used in conjunction with an appropriately sized hex wrench 35 held magnetically in an aperture on the extendable shaft 28 on the end of handle 12 to move the chain tool screw and pin arrangement 26, 27 inwardly and outwardly for fixing the chain of a bicycle or the like by placing the adjacent chain links on the members A, B of the chain tool 18 and turning the handle 12 to place a connection pin between the chain links.

Figure 3:
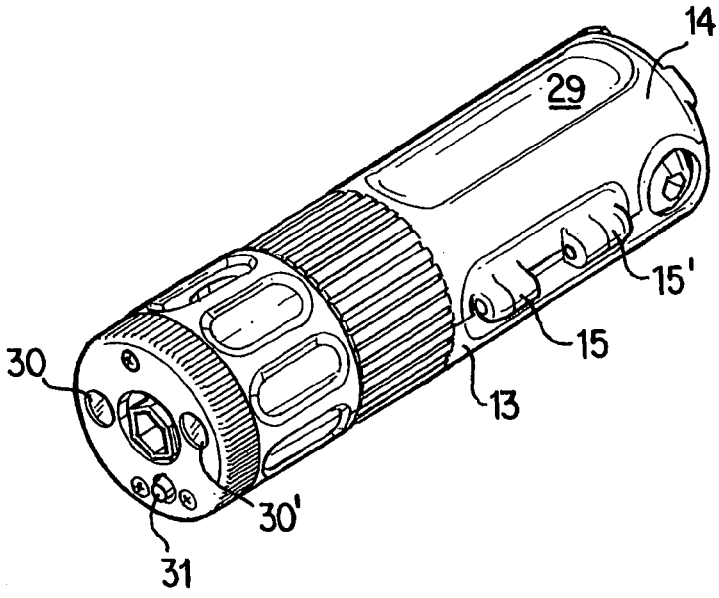
FIG. 3 is a perspective view similar to FIG. 1 but with the cover of the one handle in a fully closed position and the multiple tools in a fully retracted position.

The second handle 12 of the tool body 10 is provided with the two LED lights 30, 30' that are activated by a push button 31 in a generally known manner. The cylindrical portion 23 forming the end of the handle 11 is sized to frictionally fit with and be held on a portion 32 extended from the end of the handle 12. A lock-and-release mechanism (e.g., a bayonet-type arrangement) of a generally known type can be provided to hold the handles 11, 12 firmly together as shown in FIG. 3 when using the tool 10 but which can be quickly separated into two separate handles 11, 12 as shown in FIG. 2 by relative rotation of the handles 11, 12, e.g., a half turn.

Figure 4:
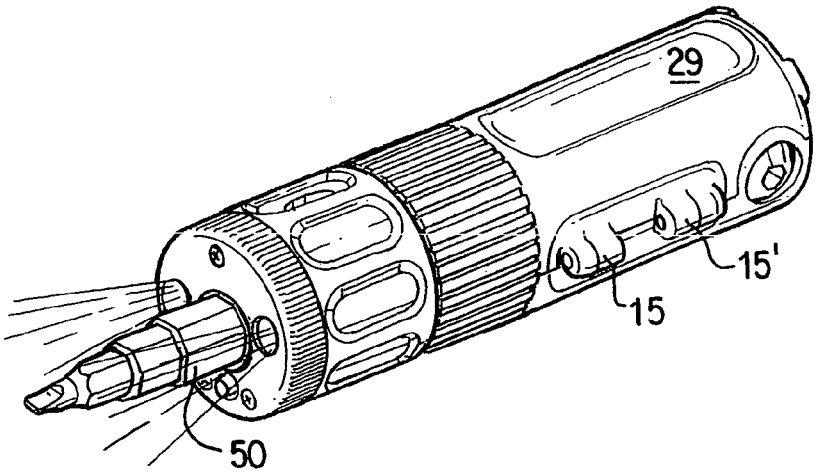
FIG. 4 is a perspective view similar to FIG. 3 but with a hex wrench partially extended from the other handle on a bendable shaft and with the LED lights activated.

As seen in FIG. 2, the handle 12 accommodates an extendable shaft 50 which can be released by a button 51 and moved in the direction of the single headed arrow into a partially extended position (FIG. 4) or the fully extended position (FIG. 5). In an alternative embodiment, the shaft can be spring actuated into an extended position. In the fully extended position, the joint 52 in the shaft 50 is outside the handle 12 whereby a hex wrench or other type of wrench 53 which is magnetically held in the shaft 50 can be used for torquing with extra leverage and/or for reaching places difficult to access. As seen in FIG. 2, the other end of the handle 12 can have apertures with magnets for selectively holding a variety of tools such as wrenches 53 and screwdrivers 53' adapted to be used at the working location of the extendable shaft 50.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

I claim:

1. A tool assembly, comprising a first handle of substantially cylindrical configuration, a second handle of substantially cylindrical configuration and configured to be selectively joinable with and separated from the first handle, wherein the first handle is configured to accommodate therein a plurality of tools, and the second handle is configured to accommodate hex wrenches at one end thereof, a selectively extendable shaft through another end thereof and a plurality of lights for illuminating an area at a working location of the shaft in an extended operative position thereof.

2. The tool assembly according to claim 1, wherein the first handle comprises a first part and a second part arranged to permit access to an interior portion of the first handle in which the tools are accommodated.

3. The tool assembly according to claim 2, wherein the tools are arranged to pivot at one end of the first part.

4. The tool assembly according to claim 1, wherein the extendable shaft at the second handle is configured so as to have a free end thereof pivotable with respect to the remainder thereof to form a right angle.

5. The tool assembly according to claim 3, wherein the first and second parts are configured to cooperate with at least one of the tools which has been moved outside the first handle to an operative position whereby the at least one tool is capable of applying torque in clockwise and counterclockwise direction.

6. The tool assembly according to claim 1, wherein one of the tools is a chain tool for repairing links.

7. The tool assembly according to claim 6, wherein the chain tool has an L-shaped portion sized and configured to cooperate with exterior surfaces of the lower part.

8. The tool assembly according to claim 6, wherein the first handle is operative to cooperate with the chain tool for repairing a chain.

9. The tool assembly according to claim 6, wherein the chain tool is configured to hold adjacent links of a chain and is provided with means for inserting a connecting pin between the links.

10. The tool assembly according to claim 1, wherein the tools include a chain tool, a container opener, and a plurality of wrenches selected from the group consisting of one or more box wrenches and spoke wrenches.

11. The tool assembly according to claim 4, wherein the extendable shaft is configured selectively hold and release different size hex wrenches and screwdrivers.

12. The tool assembly according to claim 11, wherein the first handle comprises a first part and a second part arranged to permit access to an interior portion of the first handle in which the tools are accommodated.

13. The tool assembly according to claim 12, wherein the tools are arranged to pivot at one end of the first part.

14. The tool assembly according to claim 13, wherein the first and second parts are configured to cooperate with at least one of the tools which has been moved outside the first handle to an operative position whereby the at least one tool is capable of applying torque in clockwise and counterclockwise direction.

15. The tool assembly according to claim 14, wherein the first and second parts are hingedly connected together.

16. The tool assembly according to claim 15, wherein one of the tools is a chain tool for repairing links.

17. The tool assembly according to claim 16, wherein the chain tool has an L-shaped portion sized and configured to cooperate with exterior surfaces of the lower part.

18. The tool assembly according to claim 16, wherein the first handle is operative to cooperate with the chain tool for repairing a chain.

19. The tool assembly according to claim 15, wherein the tools include a chain tool, a container opener, and a plurality of wrenches selected from the group consisting of one or more box wrenches and spoke wrenches.

20. The tool assembly according to claim 19, wherein the extendable shaft is configured selectively hold and release different size hex wrenches and screwdrivers.

* * * * *